US006129265A

United States Patent [19]

Perryman et al.

[11] Patent Number: 6,129,265

[45] Date of Patent: Oct. 10, 2000

[54] BEVERAGE CONTAINER WITH ENTERTAINMENT FEATURES

[76] Inventors: David G. Perryman, 863 Amsterdam Ave., Atlanta, Ga. 30306; Bradley K. Groff, 613 S. Candler St., Decatur, Ga. 30030

[21] Appl. No.: 09/173,335

[22] Filed: Oct. 15, 1998

[51] Int. Cl.[7] ..... B65D 77/28

[52] U.S. Cl. ..... 229/103.1; 116/2; 116/264; 446/202; 446/204; 446/200; 446/201; 239/33; 220/705

[58] Field of Search ..... 222/39; 116/2, 116/137 R, 7, 25, 264, 265, 266, 268; 446/202, 203, 204, 205, 206, 207, 208; 215/388; 220/705; 239/33

[56] References Cited

U.S. PATENT DOCUMENTS

| | | | |
|---|---|---|---|
| D. 275,542 | 9/1984 | Hacke | D7/300.2 |
| 2,107,981 | 2/1938 | Ford | 116/2 X |
| 2,544,594 | 3/1951 | Goldfarb | 446/202 X |
| 3,572,660 | 3/1971 | Mahon | 222/400.7 X |
| 3,716,017 | 2/1973 | Greene | 116/137 R |
| 3,873,735 | 3/1975 | Chalin et al. | 426/87 |
| 3,879,885 | 4/1975 | Fabricant | 446/202 |
| 4,121,375 | 10/1978 | Erickson et al. | 446/204 |
| 4,127,962 | 12/1978 | Arzola | 446/206 |
| 4,270,533 | 6/1981 | Andreas | 222/95 |
| 4,631,715 | 12/1986 | Hoover | 206/217 X |
| 4,850,496 | 7/1989 | Rudell et al. | 215/12.1 |
| 4,925,470 | 5/1990 | Chou | 62/4 |
| 5,156,275 | 10/1992 | Murray, Sr. | 206/581 |
| 5,482,202 | 1/1996 | Wen | 229/103.1 |
| 5,939,983 | 8/1999 | Rudell et al. | 426/104 X |

*Primary Examiner*—Stephen P. Garbe
*Assistant Examiner*—Tri M. Mai
*Attorney, Agent, or Firm*—Needle & Rosenberg, P.C.

[57] ABSTRACT

A drink box beverage container having one or more entertainment features, such as a whistle, horn or pinwheel, actuated by suction applied through a drinking straw inserted into the container.

6 Claims, 5 Drawing Sheets

BEVERAGE CONTAINER WITH ENTERTAINMENT FEATURES

BACKGROUND OF THE INVENTION

1. Field of the Invention

The present invention relates generally to beverage containers, and more specifically to a paperboard drink box wherein suction used to draw the beverage from the container actuates a sound generating device such as a whistle or horn, and/or a physical movement of an associated visual entertainment device such as a pinwheel.

2. Description of Related Art

Paperboard containers for beverages have gained in popularity since their introduction. These containers are typically formed by folding and glueing a cut and scored paperboard blank to form a drink box. The paperboard may be coated or laminated to resist permeation by liquid contents, or a liquid-proof liner or bag can be provided in the container's interior volume for containing the liquid contents. An attached drinking straw is inserted through a penetrable portion of the container for suction removal of the liquid contents.

Paperboard containers are especially popular for serving milk, juice, and soft drinks to children. Their materials of construction eliminate potential sources of injury inherent in other containers, such as broken glass from bottles, and sharp edges from metal cans. Drink boxes also reduce the likelihood of spilled liquid contents and, in the event a spill occurs, the quantity of liquid released is typically less than with open containers. This is primarily due to the close engagement or sealing contact between the drinking straw and the surrounding penetrable portion of the container.

Even with its many advantages the paperboard containers have disadvantages. For example, the seal between the drinking straw and the container can create a vacuum when the liquid is sucked which makes drinking difficult. In addition, as any parent knows, if the box is squeezed, the liquid can squirt from the straw. Undetected these spill can create dangerous situations where children congregate.

Studies have recently shown that musical skill can develop a portion of the brain which is smaller in children not exposed to music and musical skills. Thus, there is a great need to develop early music skills in children. It would be advantageous, therefore, if children could be exposed to the creation of music in their everyday activities.

The external surfaces of existing paperboard drink boxes are typically printed with graphics and text identifying the contents, providing nutritional information, and presenting point of sale marketing features. The structure of existing drink boxes themselves, however, is generally substantially identical from one manufacturer to the next. Consumers typically do not recognize any distinctions between existing drink boxes, and rarely gain any enjoyment from the boxes, apart from the beverage contained therein. Thus it has been found that a need exists for a beverage container that increases the consumers' enjoyment of use, and that is readily distinguished from other containers. It is to the provision of a container meeting these and other needs that the present invention is primarily directed.

SUMMARY OF THE INVENTION

Briefly described, in preferred form, one aspect of the present invention is a device for dispensing a liquid, the device including a container bounding a contained volume for containing a quantity of a liquid, a straw having a first end within the contained volume and a second end external of the container, and means for generating sensory stimulation upon application of suction to the contained volume through said straw.

The means for generating sensory stimulation preferably take the form of any or several of a number of entertainment features, including without limitation, sound generating devices such as whistles and horns, and/or movable elements such as pinwheels. Two or more such entertainment features may be included, for example, whistles or horns having different tones and capable of being selectively actuated. The generated sounds can be variable dependant on the magnitude of suction applied through the straw.

These features are preferably actuated by airflow from external of the container through a passage into the contained volume of the container, the airflow being generated by suction withdrawal of liquid contents from the container. The entertainment features are preferably adjacent or coupled to the passage, and capable of generating an audible sound or visually observable physical movement in response to at least a portion of the flow of air through the passage.

The passage preferably comprises an opening through the container that is initially covered by a removable cover to seal the container against loss of liquid contents and to prevent external contamination of liquid contents prior to use. The cover is removed by the consumer immediately prior to use, or may be left in place if desired in order to disable the entertainment features. In a preferred embodiment, the removable cover comprises a portion of the drinking straw. The straw is initially attached in a first position to an external surface of the container providing closure of the passage against airflow therethrough. The straw is detachable from the first position to open the passage to allow airflow therethrough. The first end of the straw may then be inserted through a penetrable portion of the container into the contained volume, leaving the second end of the straw external of the container.

These and other features and advantages of preferred forms of the present invention are described herein with reference to the drawing figures.

BRIEF DESCRIPTION OF THE DRAWING FIGURES

DETAILED DESCRIPTION

Figure 1:
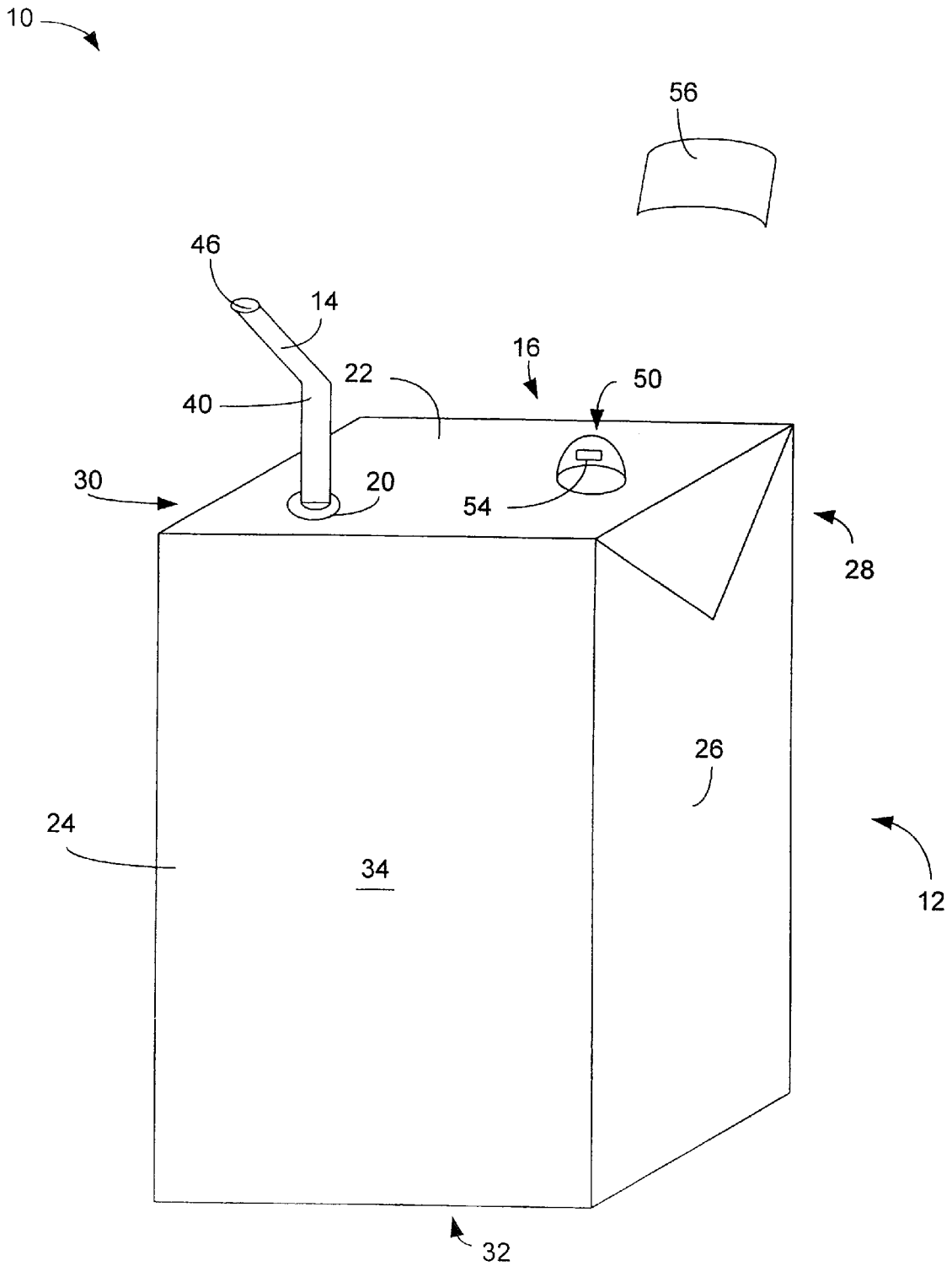
FIG. 1 shows a perspective view of a beverage container according to one form of the present invention.

Referring now to the drawing figures, wherein like reference numerals represent like parts throughout, preferred forms of the present invention will now be described. FIGS. 1–4 show preferred embodiments of a device 10 for dispensing a liquid. The device 10 preferably generally comprises a container 12, a drinking straw 14, and means 16 for generating sensory stimulation.

The container 12 of the present invention is preferably a paperboard drink box formed from a paperboard blank by folding and glueing according to techniques known in the art. Alternate structures and materials of construction for container 12 are possible, including without limitation, plastic boxes, tubes, bottles and cans. The container 12 can be formed of a liquid-proof material, or can be provided with a liquid proof liner, coating, laminate, or inner container. The container 12 preferably comprises a penetrable portion 20 permitting insertion of the straw 14 therethrough by the consumer prior to use. The penetrable portion 20 may be, for example, a hole provided through the container 12 exposing a portion of a liner provided withing the container. The container 12, when taking the form of a rectangular drink box as depicted in the figures, comprises a top 22, four sides 24, 26, 28, 30, and a bottom 32. The container 12 defines an external surface 34, and bounds an internal contained volume for containing a quantity of a liquid.

Figure 2:
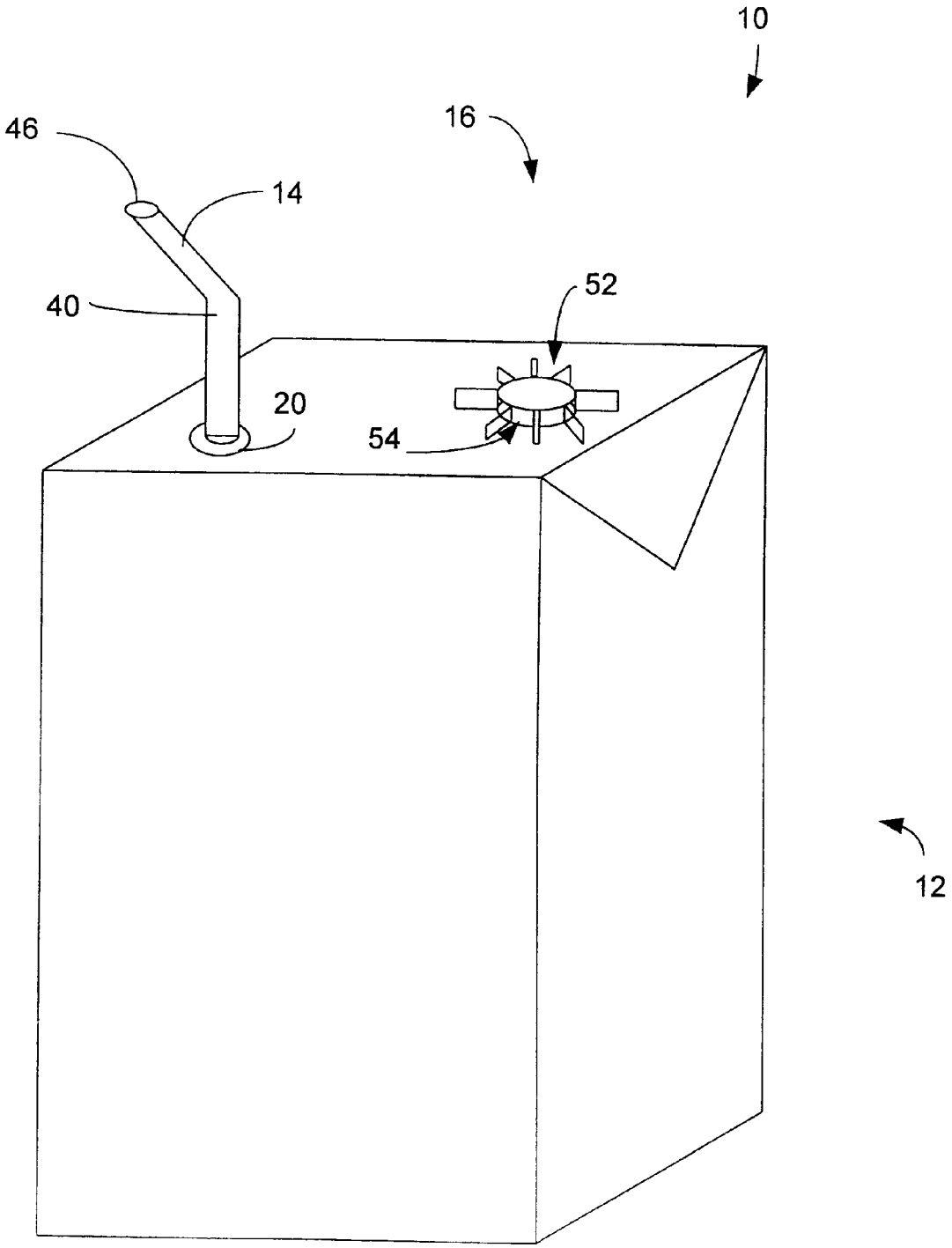
FIG. 2 shows a perspective view of a beverage container according to another form of the present invention.
Figure 3:
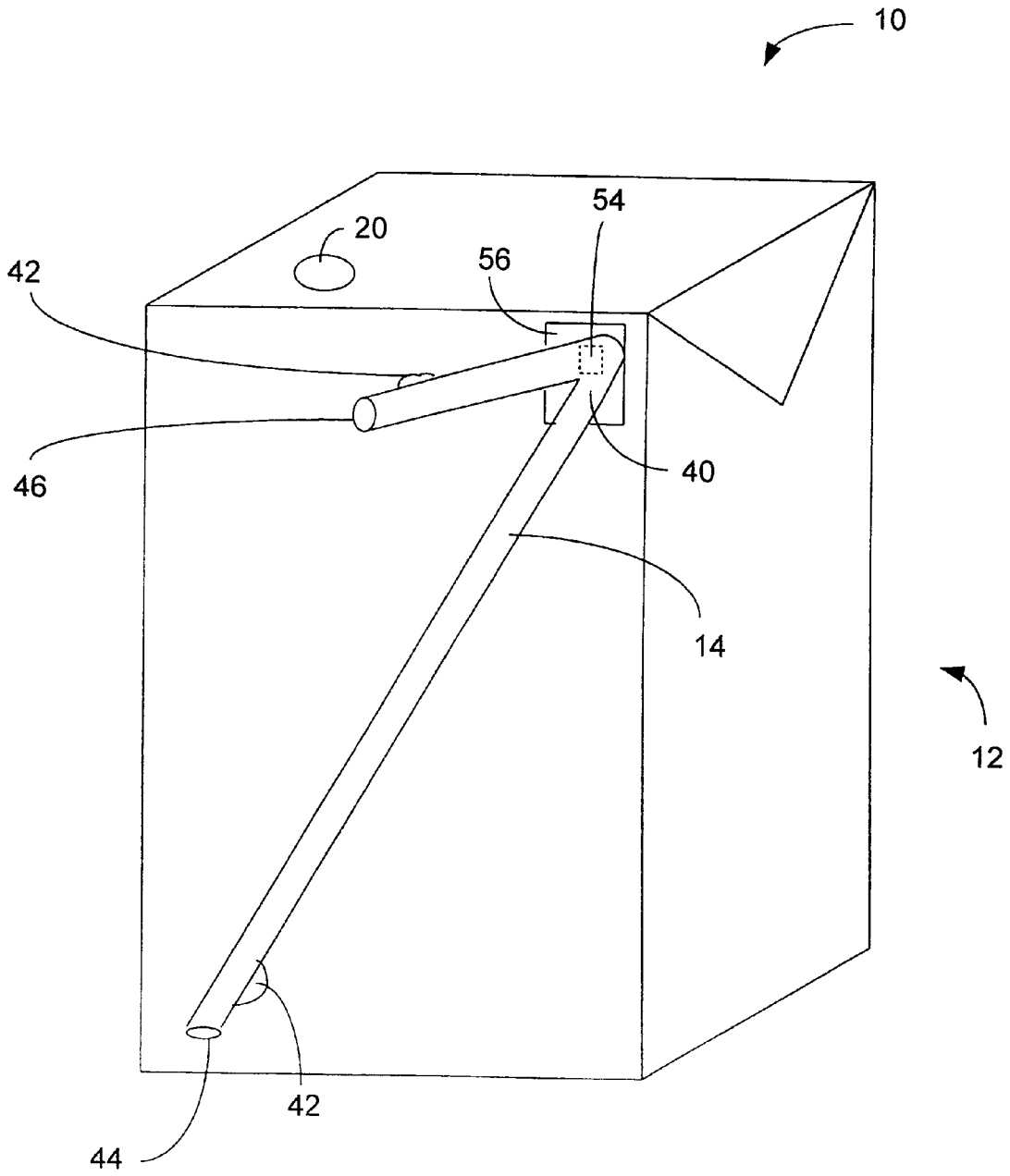
FIG. 3 shows a perspective view of a beverage container according to another form of the present invention.
Figure 4:
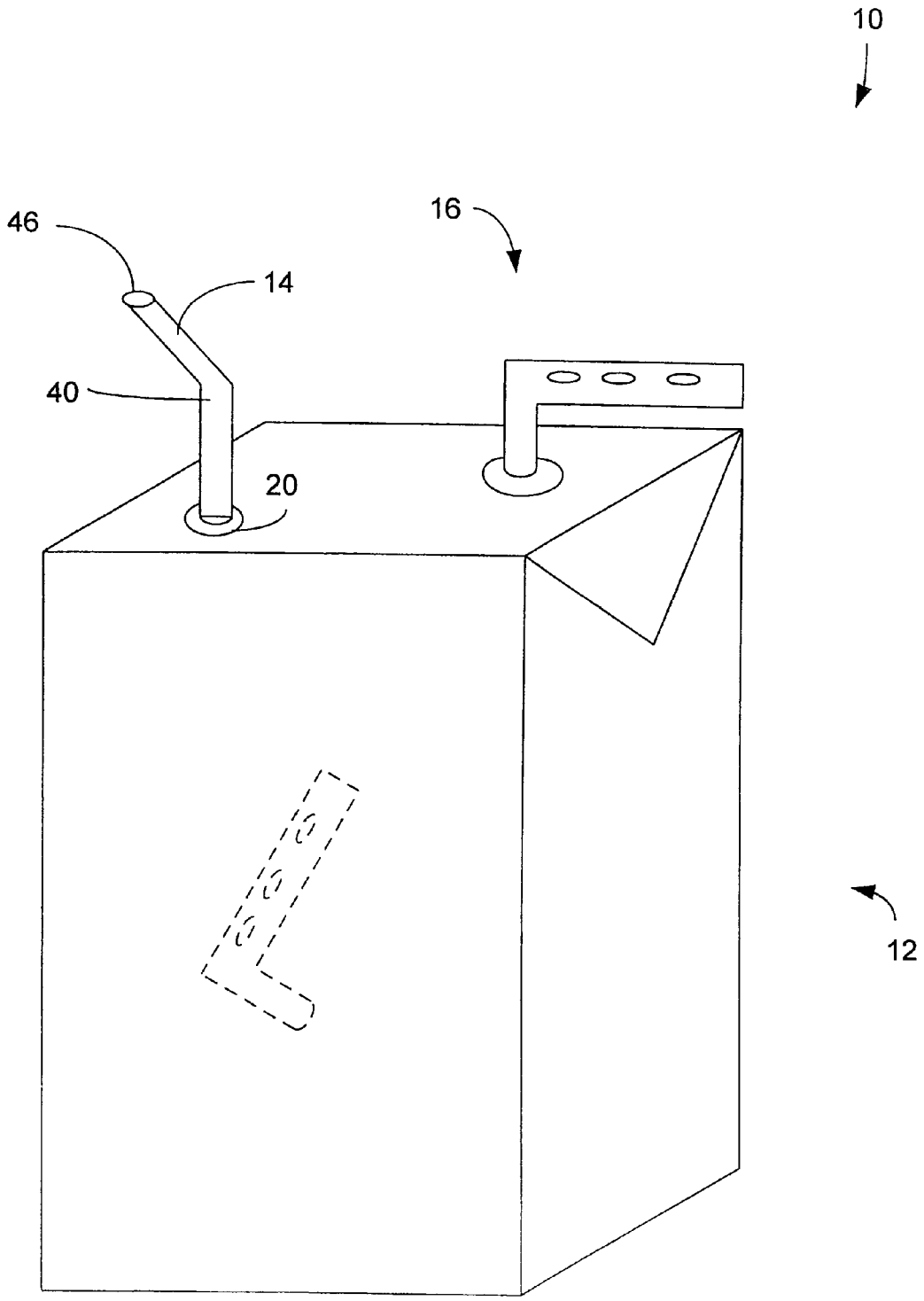
FIG. 4 shows a perspective view of a beverage container according to another form of the present invention.

The drinking straw 14 need not be provided with the device but preferably is provided and preferably comprises a hollow plastic tube of known construction. The drinking straw 14 may be provided with a segmented portion 40 providing improved flexibility for ease of use. The drinking straw 14 is preferably initially removably attached to the external surface 34 of the container 12 in a first position such as shown in FIG. 3, by releasable attachment means such as a relatively weak adhesive 42. The drinking straw 14 is manually detachable by the consumer from the first position, and can then be inserted through the penetrable portion 20 of the container 12 into a second position, depicted in FIGS. 1–2, wherein a first end 44 of the drinking straw 14 is within the contained volume of the container 12 in contact with the contained liquid, and a second end 46 of the drinking straw 14 is placed external of the container 12. The drinking straw 14 can be covered with a protective covering such as a cellophane sheet or packet in its first position, to prevent contamination of the drinking straw 14.

The device 10 of the present invention preferably further comprises one or more means 16 for generating sensory stimulation. The means 16 is preferably pre-attached to device 10 but can also be removably attached to an external surface 34 of the container 12, as shown in broken lines in FIG. 4, and inserted through a penetrable portion of the container 12 in similar manner to the straw 14, as shown in solid lines in FIG. 4. The means 16 can comprise any of a number of entertainment features such as a sound generating device 50, as shown in FIG. 1, and/or a movable element 52, as shown in FIG. 2. The sound generating device can be, for example, a whistle, flute, or a horn. The movable element 52 can be, for example, a pinwheel or other rotating or reciprocating apparatus. The means 16 is preferably actuated by an airflow through a passage 54 provided through the container 12. The passage 54 is preferably an opening formed in the container 12 that communicates a flow of air from external of the container 12 into the contained volume upon application of suction to the contained volume through the straw 14. As liquid is removed from the container by suction through the straw 14, the airflow is drawn through the passage 54, due to the suction-induced pressure differential, to replace the volume of fluid removed. The presence of passage 54 also prevents the formation of any significant vacuum within the container, as typically makes drinking difficult with similar conventional containers. In addition the passage 54 can provide a positive pressure release to aid in preventing fluid outflow through inserted straw 14 when the box is squeezed and the straw is not in one's mouth. The means 16 is mounted or formed adjacent or within the passage 54, such that at least a portion of the airflow through the passage operates upon the means 16 to generate sound, motion or other sensory stimulus. The sound device 50 can also include a flap which opens only in an internal direction, functioning as a check valve, such that liquid cannot flow out but air can flow into the container 12.

The passage 54 is preferably initially closed by a removable cover 56, to prevent loss of liquid from the contained volume, and to prevent contamination of the liquid from the external environment. The removable cover 56 may comprise a flexible strip of pressure sensitive adhesive, as shown in FIG. 1, which is removed by the consumer prior to consumption. If the removable cover is left in place during consumption or reinstalled in place after removal, the means 16 for generating sensory stimulation will be disabled, and the container 12 will function in the manner of previously existing drink box beverage containers. In this manner, the means 16 can be selectively enabled or disabled by the consumer. In an alternate embodiment depicted in FIG. 3, the removable cover 56 comprises a portion of the drinking straw 14, which covers the passage 54 when the drinking straw is in its initial first position as shown, and closes the passage 54 against airflow therethrough. Detachment of the drinking straw 14 from the external surface 34 of the container 12 opens the passage 54 to airflow therethrough.

Figure 5:
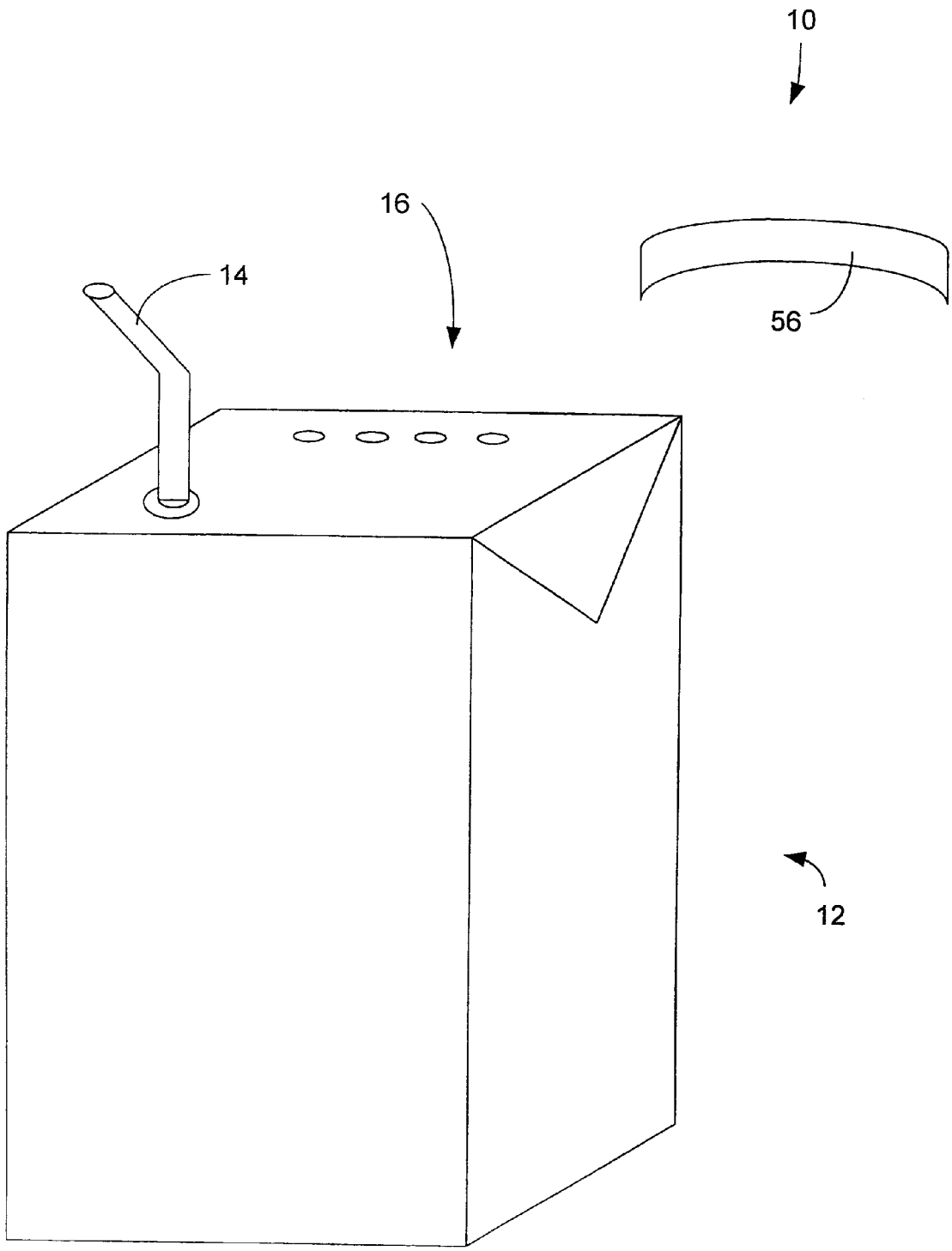
FIG. 5 shows a perspective view of a beverage container according to another form of the present invention.

In alternate forms of the present invention, the means 16 for generating sensory stimulation can take a variety of forms, providing a number of different advantages. For example, the means 16 can comprise two or more independent or coupled entertainment features. For example, the movable element 52 can be coupled with a sound generating device 50, so that upon application of suction through the straw 14, visible motion and audible sound are generated. Two or more sound generating devices may be provided, each generating a sound having a different tone or volume. Means, such as finger holes or other actuators, for selectively generating sounds from one or more of the sound generating devices can be provided to the means 16. One or more variable tone sound generating devices can be provided, having a finger operated slide or other means for selectively varying the tone of the sound generated. In an example embodiment shown in FIG. 5, the sound generating devices can comprise two or more holes provided in the top of a container, whereby different holes can be selectively covered with one's fingers to produce sounds having different tones.

Two or more containers 12, substantially as described above, can be sold in a multiple unit package, and can be provided with like, different or similar entertainment features. For example, each container in an eight-pack of containers can be provided with a sound generating device generating a different note of an octave, whereby the cooperative efforts of multiple consumers can generate a tune. It is also envisioned that containers 12 of different sizes or content can be provided with sound generating devices having different tones or volumes, so that the sound generated by consumption of liquid from the container designates the size or content of the container. Sound generating devices having unique, identifiable sounds may be selected by a manufacturer as a source-designating feature of their product, allowing the sounds generated by the containers to function as a trademark of a particular manufacturer.

While the invention has been described in its preferred forms, it will be readily apparent to those of ordinary skill in the art that many additions, modifications and deletions can be made thereto without departing from the spirit and scope of the invention.

What is claimed is:

1. A device for dispensing a liquid, said device comprising:

(a) a closed container bounding a contained volume for containing a quantity of a liquid;

(b) a straw having a first end within the contained volume and a second end external of said container; and (c) a whistle attached to the container in communication with a passage extending between the interior and exterior of the container for generating sound as air is drawn through said whistle into said container upon application of suction to the contained volume through said straw.

2. The device of claim 1, wherein said whistle generates a sound selected to function as a source designating feature of the device.

3. A multiple container package of at least two devices according to claim 1, wherein said whistle of selected devices in said multiple container package generate sounds of different pitch from said whistle of other devices in said multiple container package.

4. The device of claim 1, wherein said container is a paperboard drink box.

5. A device for dispensing a liquid, said device comprising:

(a) a closed container bounding a contained volume for containing a quantity of a liquid;

(b) a straw having a first end for insertion within the contained volume and a second end for placement external of said container;

(c) a passage through said container, for communicating a flow of air from external of said container into said contained volume upon application of suction to the contained volume through said straw; and (d) a whistle and in communication with adjacent said passage and capable of generating an audible sound in response to the flow of air.

6. The device of claim 5, wherein said whistle comprises means for selectively varying the audible sound generated.

* * * * *